US007296446B1

(12) United States Patent
Miao

(10) Patent No.: US 7,296,446 B1
(45) Date of Patent: Nov. 20, 2007

(54) LOCK ASSEMBLY

(75) Inventor: Tony Miao, Taipei Hsien (TW)

(73) Assignee: Jin Tay Industries Co., Ltd. (TW)

( * ) Notice: Subject to any disclaimer, the term of this patent is extended or adjusted under 35 U.S.C. 154(b) by 0 days.

(21) Appl. No.: 11/449,635

(22) Filed: Jun. 9, 2006

(51) Int. Cl.
*E05B 73/00* (2006.01)

(52) U.S. Cl. ..... 70/14; 70/58; 70/223; 70/232; 70/422; 70/DIG. 57

(58) Field of Classification Search ..... 70/14, 70/18, 58, 229–232, 188, 189, DIG. 57, 223, 70/422
See application file for complete search history.

(56) References Cited

U.S. PATENT DOCUMENTS 1,667,986 A * 5/1928 Raleigh ..... 70/231
1,726,516 A * 8/1929 Parker ..... 70/259
5,388,434 A * 2/1995 Kalis ..... 70/58
5,479,799 A * 1/1996 Kilman et al. ..... 70/231
6,588,242 B1 * 7/2003 Beaty ..... 70/231
7,073,358 B1 * 7/2006 Lee ..... 70/58
7,076,977 B2 * 7/2006 Lee ..... 70/58

* cited by examiner

*Primary Examiner*—Lloyd A. Gall
(74) *Attorney, Agent, or Firm*—Hershkovitz & Associates, LLC; Abe Hershkovitz

(57) ABSTRACT

A lock assembly has a casing, a securing axle and a wheel. The securing axle is mounted rotatably in the casing and has a threaded end extending out of the casing. The wheel is mounted rotatably in the casing and selectively engages with the securing axle to rotate the securing axle. By rotating the wheel and the securing axle simultaneously, the threaded end of the securing axle can be screwed into an article. When the wheel disengages from the securing axle, the wheel cannot rotate the securing axle to keep the securing axle in the article. Then the article is in a position in cooperation with a cable.

5 Claims, 7 Drawing Sheets

LOCK ASSEMBLY

BACKGROUND OF THE INVENTION

1. Field of the Invention

The present invention relates to a lock, and more particularly to a lock assembly can be used to secure an object in a position conveniently in cooperation with a cable.

2. Description of Related Art

Locks are widely used to prevent objects from being stolen and are developed into different types for different purposes. But, locks of securing an object in a position are not fully developed.

When articles are displayed in a business show or in stores, the articles are probably fastened via ropes or steel cables in concern of the articles. However, to fasten an article via ropes or steel cables is troublesome and time consuming. Moreover, unauthorized personnel might still untie the ropes or the steel cables and steal the articles.

To overcome the shortcomings, the present invention provides a lock assembly to obviate or mitigate the aforementioned problems.

SUMMARY OF THE INVENTION

The primary objective of the invention is to provide a lock assembly comprising a casing, a securing axle and a wheel. The securing axle is mounted rotatably in the casing and has a threaded end extending out of the casing. The wheel is mounted rotatably in the casing and selectively engages with the securing axle to rotate the securing axle. By rotating the wheel and the securing axle simultaneously, the threaded end of the securing axle can be screwed into an article. When the wheel disengages from the securing axle, the wheel cannot rotate the securing axle to keep the securing axle in the article. Then the article is in a position in cooperation with a cable.

In another objective of the invention, a lock cylinder is provided to control the engagement between the securing axle and the wheel. Users can lock and unlock the lock cylinder by a key to control the engagement between the wheel and the securing axle. Therefore the lock assembly of the present invention may be used conveniently.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
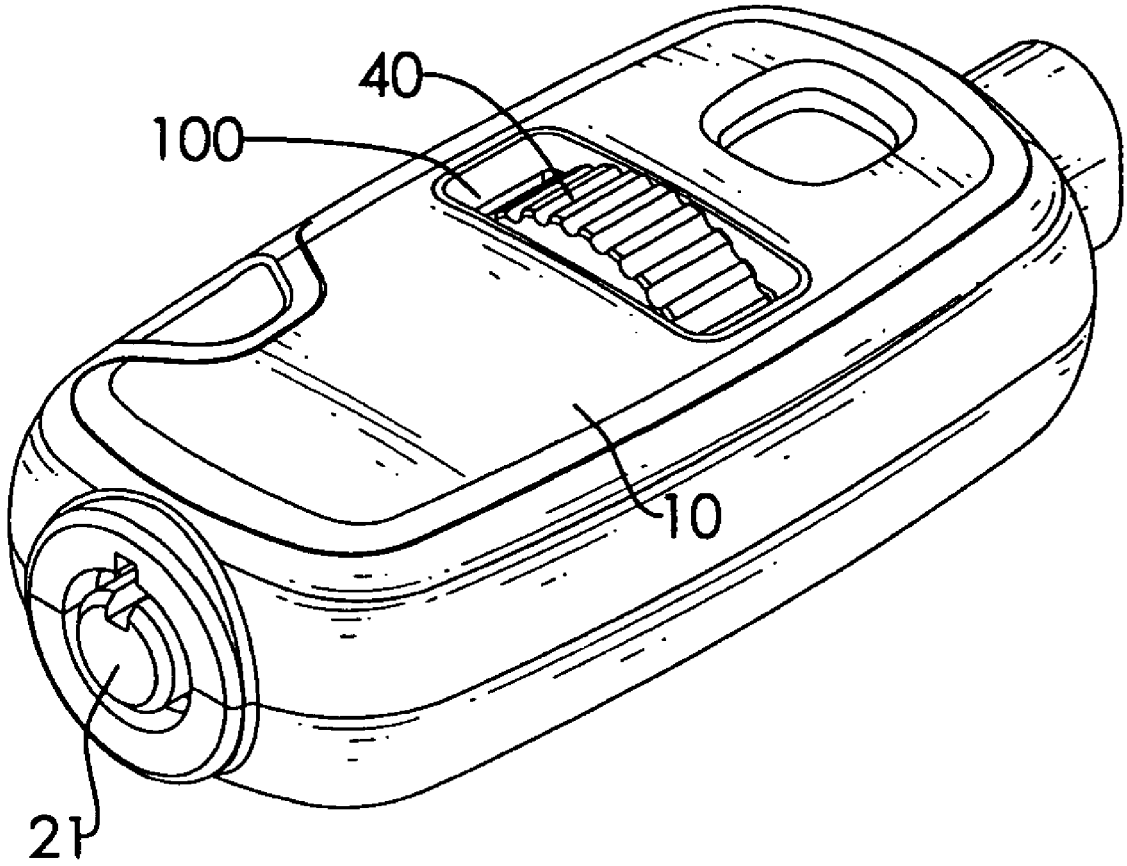
FIG. 1 is a perspective view of the lock assembly in accordance with the present invention.
Figure 2:
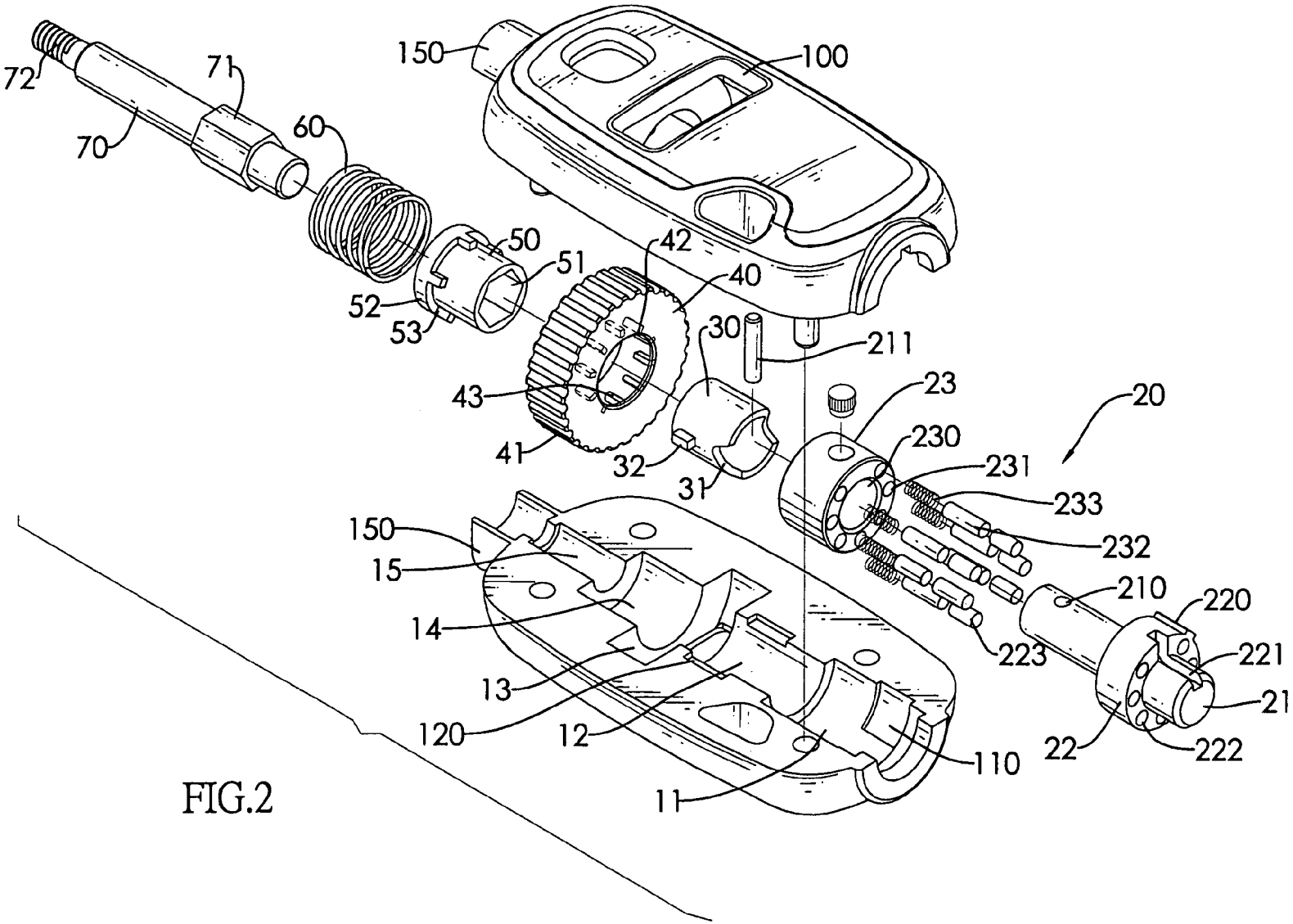
FIG. 2 is an exploded perspective view of the lock assembly in FIG. 1.
Figure 4:
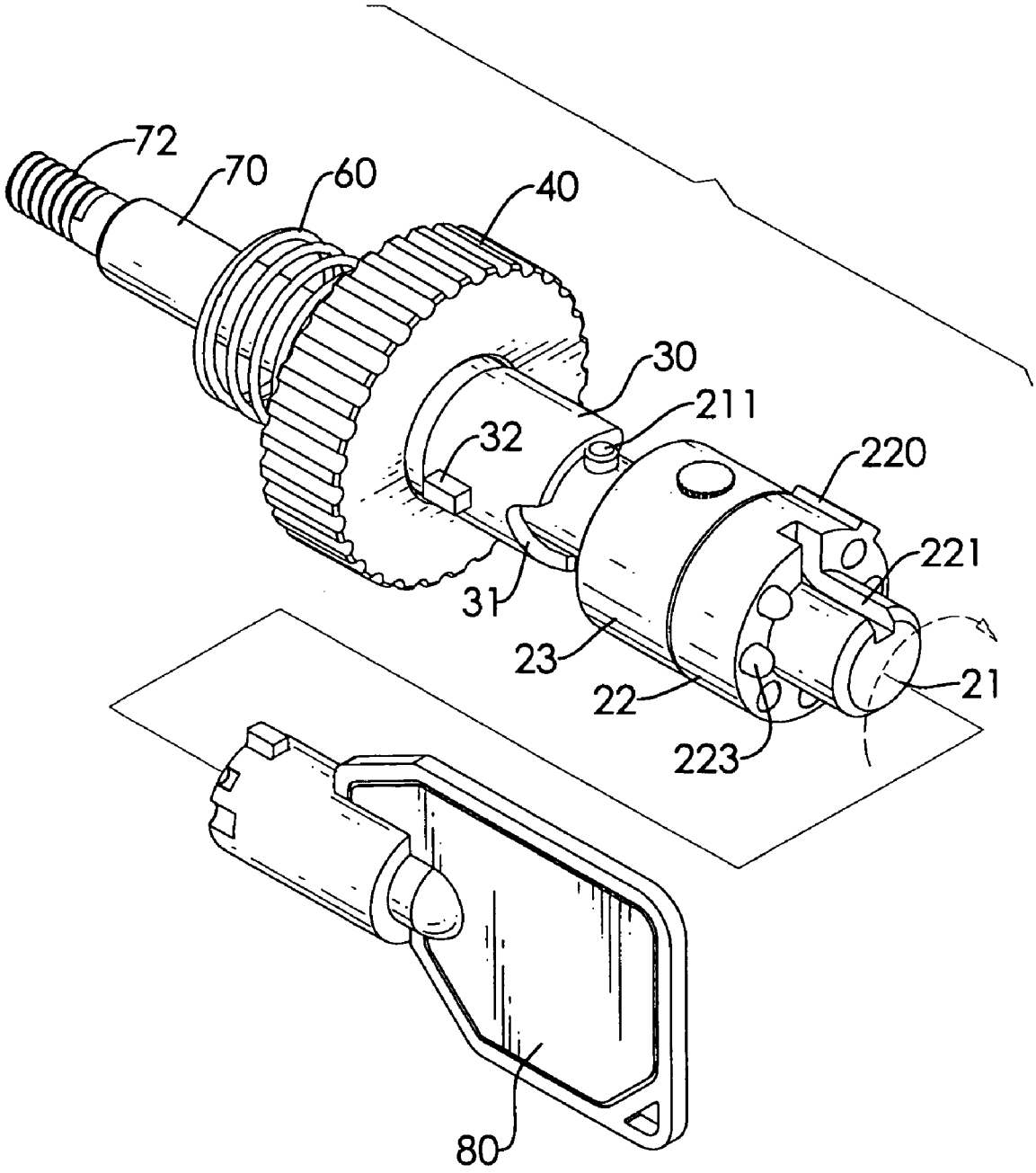
FIG. 4 is an exploded perspective view of the cylinder lock in FIG. 1 with an associated key.
Figure 7:
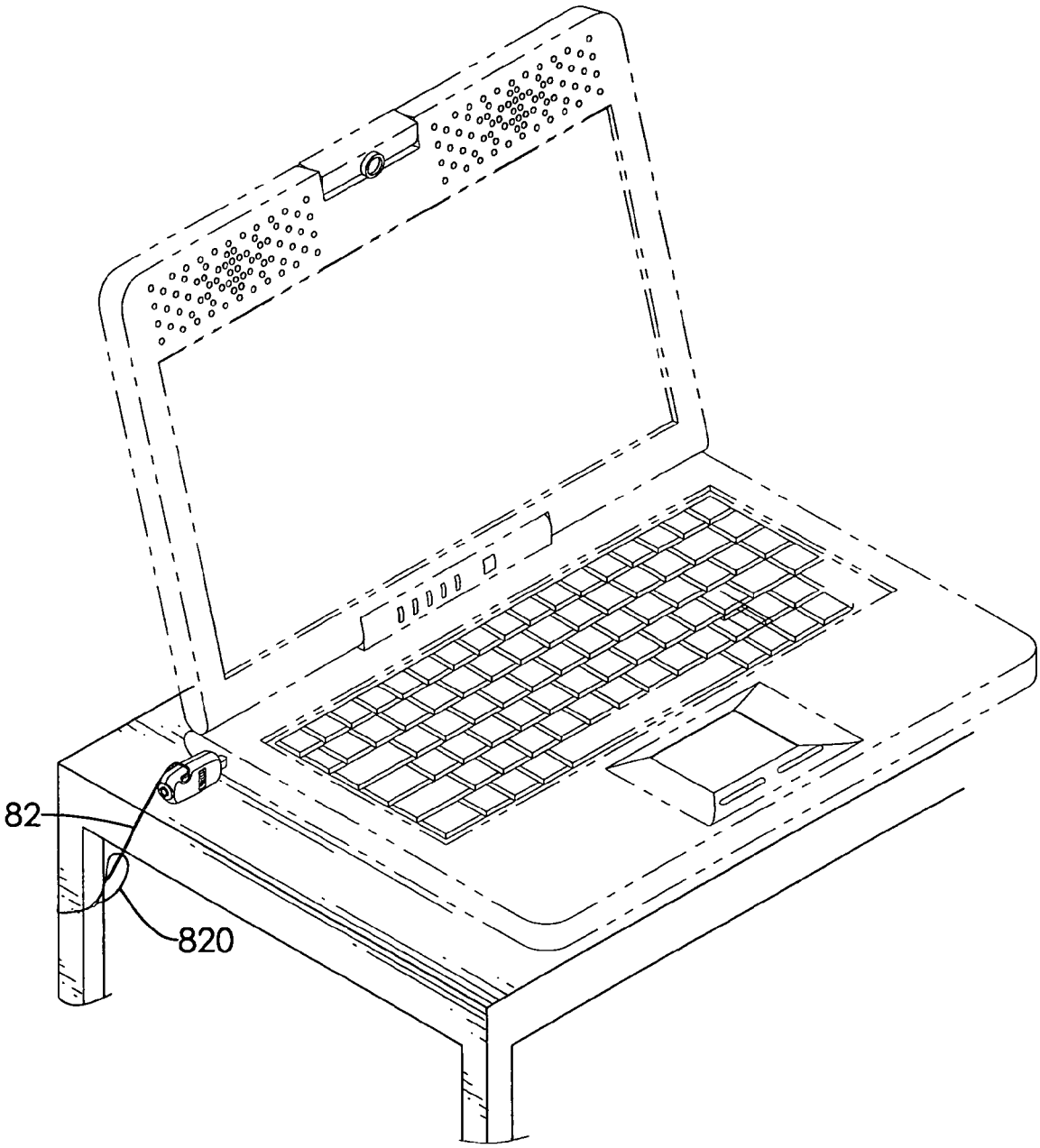
FIG. 7 is a perspective view of the lock assembly in FIG. 1 cooperating with a cable to fasten a notebook in a position.

With reference to FIGS. 1 and 2, the lock assembly in accordance with the present invention comprises a casing (10), a lock cylinder (20), an active tube (30), a wheel (40), an active bracket (50), a resilient element (60) and a securing axle (70). With further reference to FIG. 4, the lock assembly of the present invention is locked and unlocked by an associated key (80) and is used with an operational cable (82) as shown in FIG. 7.

The casing (10) is composed of a bottom case and a top case and has a proximal end, a distal end and a receiving space defined between the bottom case and the top case. The top case has a surface and an opening (100) defined through the surface of the top case. The receiving space has a first chamber (11), a second chamber (12), a third chamber (13), a fourth chamber (14) and a fifth chamber (15) formed in sequence. The first chamber (11) has a cave (110) formed transversely in the casing (10) near the proximal end of the casing (10). The second chamber (12) has two sides and two slots (120) respectively defined at the two sides of the second chamber (12).

Figure 3:
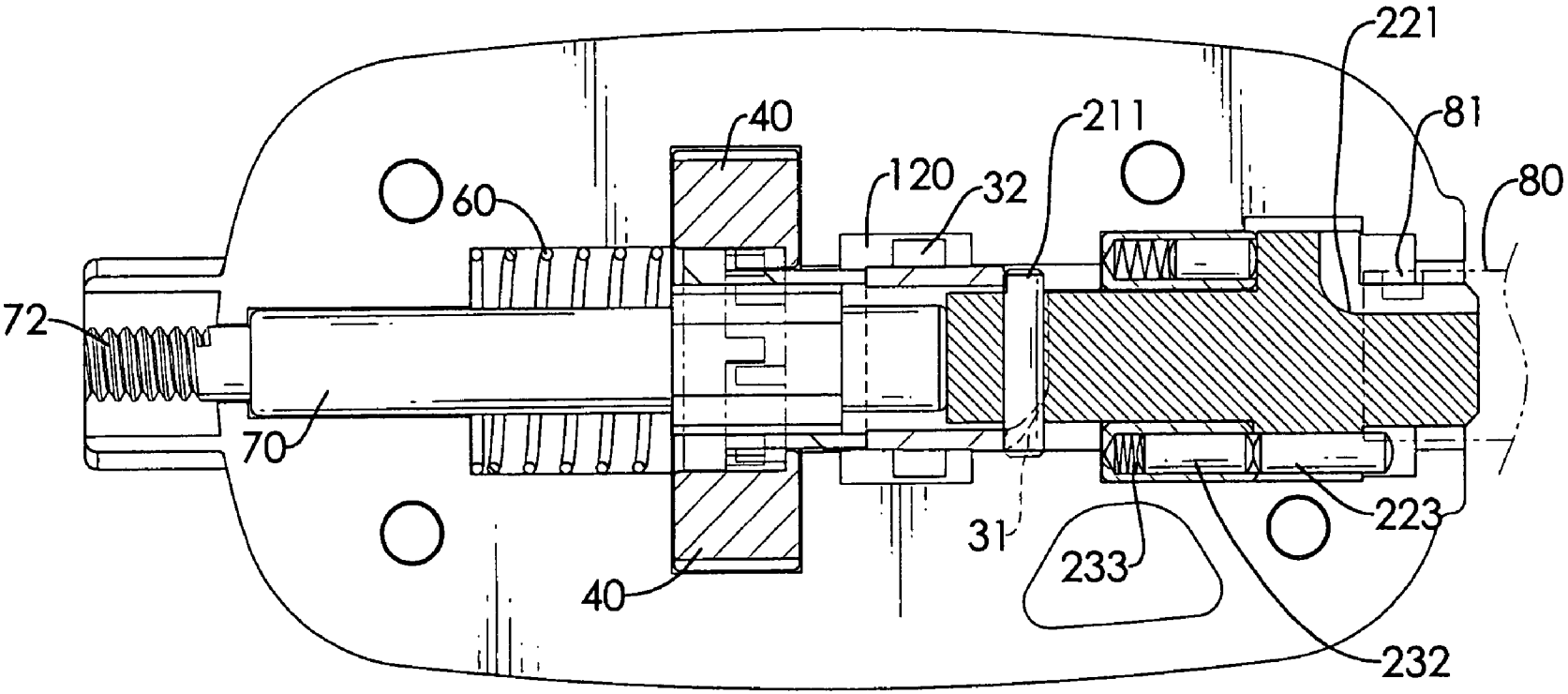
FIG. 3 is a top view in partial cross section of the lock assembly of FIG. 1 in an unlock position.

With further reference to FIG. 3, the lock cylinder (20) is mounted in the chamber (11) and comprises a stationary cylinder (23) and a locking bar (21).

The stationary cylinder (23) is securely held inside the first chamber (11) of the casing (10) and comprises an end surface, a center hole (230), multiple bores (231), multiple tumbler pins (232) and tumbler springs (233). The central hole is defined through the stationary cylinder (23). The bores (231) are formed separately in the end surface. The tumbler pins (232) and tumbler springs (233) are mounted in the bores (231). The locking bar (21) is mounted rotatably in the first chamber (11) of the casing (10), extends through the center hole (230) in the stationary cylinder (23) and comprises a latching end, an active rod (211), an active cylinder (22) and an actuated end. The latching end is protruding out of the center hole (230) in the stationary cylinder (23) and has a through hole (210). The through hole (210) is formed transversely in the latching end. The active rod (211) is mounted in the through hole (210) with two ends protruding out of the through hole (210). The active cylinder (22) is formed radially on the locking bar (21), is coaxial with the stationary cylinder (23) and comprises an outer surface, a flange (220) and multiple pin holes (222). The flange (220) is formed longitudinally on the outer surface of the active cylinder (22) and is mounted movably in the cave (110) of the chamber (11) to limit the rotating range of the locking bar (21). The pin holes (222) are formed longitudinally through the active cylinder (22) around the locking bar (21). Each pin hole (222) has a bolt (223) mounted slidably in the pin hole (222) and corresponding to and pushed by one of the tumbler pins (232). The actuated end of the locking bar (21) has a notch (221) longitudinally formed in the actuated end.

The active tube (30) is mounted slidably in the second chamber (12) of the casing (10) and has a first end, a second end, two sides, two bosses (32) and two notches (31). The two bosses (32) are formed respectively at the two sides and near the second end of the active tube (30). Each boss (32) is mounted slidably in one of the slots (120) of the second chamber (12) of the casing (10), so that the active tube (30) can only move axially along the second chamber (12) of the casing (10). The two notches (31) are defined in the first end of the active tube (30) opposite to the latching end of the locking bar (21) and respectively correspond to the ends of the active rod (211). The notches (31) can receive the ends of the active rod (211) and each notch (31) has an inclined plane. The inclined planes of the notches (31) slidably contact with the active rod (211) when the locking bar (21) is rotating.

The wheel (40) is mounted rotatably in the third chamber (13) of the casing (10) and has a center, a hole (42) with an inner surface, and multiple teeth (43) formed around the inner surface of the hole (42). The hole (42) is formed through the center of the wheel (40). In addition, the wheel (40) has a rough surface (41) extending out of the opening (100) of the top case to facilitate a user rotating the wheel (40).

The active bracket (50) is slidably mounted rotatably in the fourth chamber (14) of the casing (10) and has an outer wall, a first end, a second end, a head (52) and a mounting hole (51). The first end of the active bracket (50) abuts the second end of the active tube (30). The head (52) is formed on the second end of the active bracket and has multiple active teeth (53). The active teeth (53) extend on the outer wall of the active bracket (50) and correspond to and selectively engage the teeth (43) in the wheel (40). The mounting hole (51) is non-circular and is formed axially through the active bracket (50).

Figure 6:
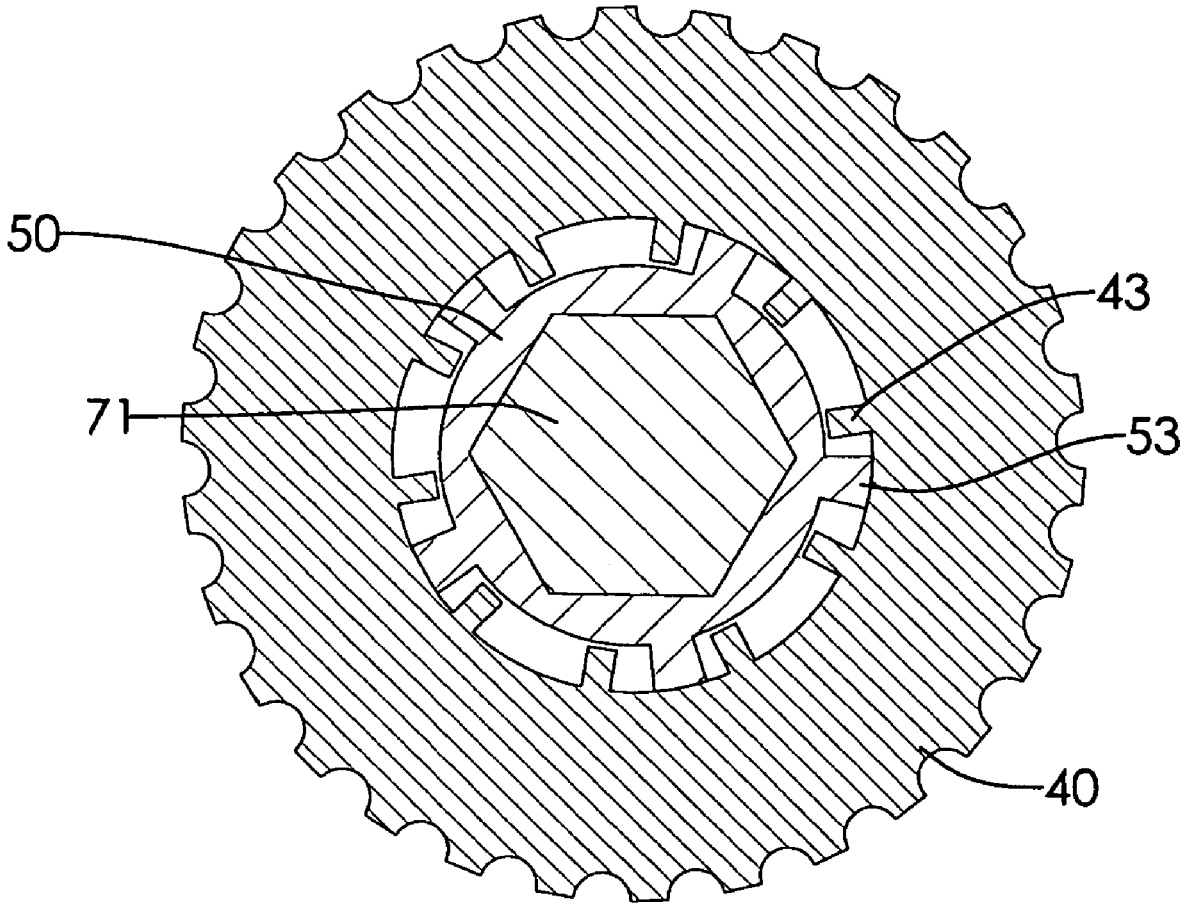
FIG. 6 is a cross sectional end view of the lock assembly in FIG. 1 showing the active teeth engaging the teeth.

With further reference to FIG. 6, the resilient element (60) is mounted in the fourth chamber (14) of the casing (10) and has an end. The end of the resilient element (60) pushes the active bracket (50) to slide along the fourth chamber (14) of the casing (10) and to engage the teeth (43) with the active teeth (53).

The securing axle (70) is mounted rotatably in the fifth chamber (15) of the casing (10) and has a threaded end (72), an active end and a mounting portion (71). The threaded end (72) extends out of the casing (10). The mounting portion (71) is formed on the securing axle (70) near the active end and is non-circular in cross section to be mounted securely in the mounting hole (51) of the active bracket (50) and to allow the securing axle (70) rotating simultaneously with the active bracket (50).

The associated key (80) has a tubular operating portion with an opening end and an inner surface, a protrusion (81) and multiple key cutouts. The protrusion (81) is formed on the inner surface to buckle with the notch (221) of the locking bar (21) to make the key (80) rotating simultaneously with the locking bar (21). The key cutouts are formed along the opening end in different sizes determined by the positions and lengths of the bolts (223) in the lock cylinder (20). The associated key (80) can hold around the actuated end of the locking bar (21) and engages with the bolts (223). Then the bolts (223) are pushed respectively by the key cutouts. Such the bolts (223) and the tumbler pins (232) are pushed to an interface between the stationary cylinder (23), the active cylinder (22), the locking bar (21) and the active rod (211) can rotate relative to the stationary cylinder (23) when the associated key (80) is turned.

Figure 5:
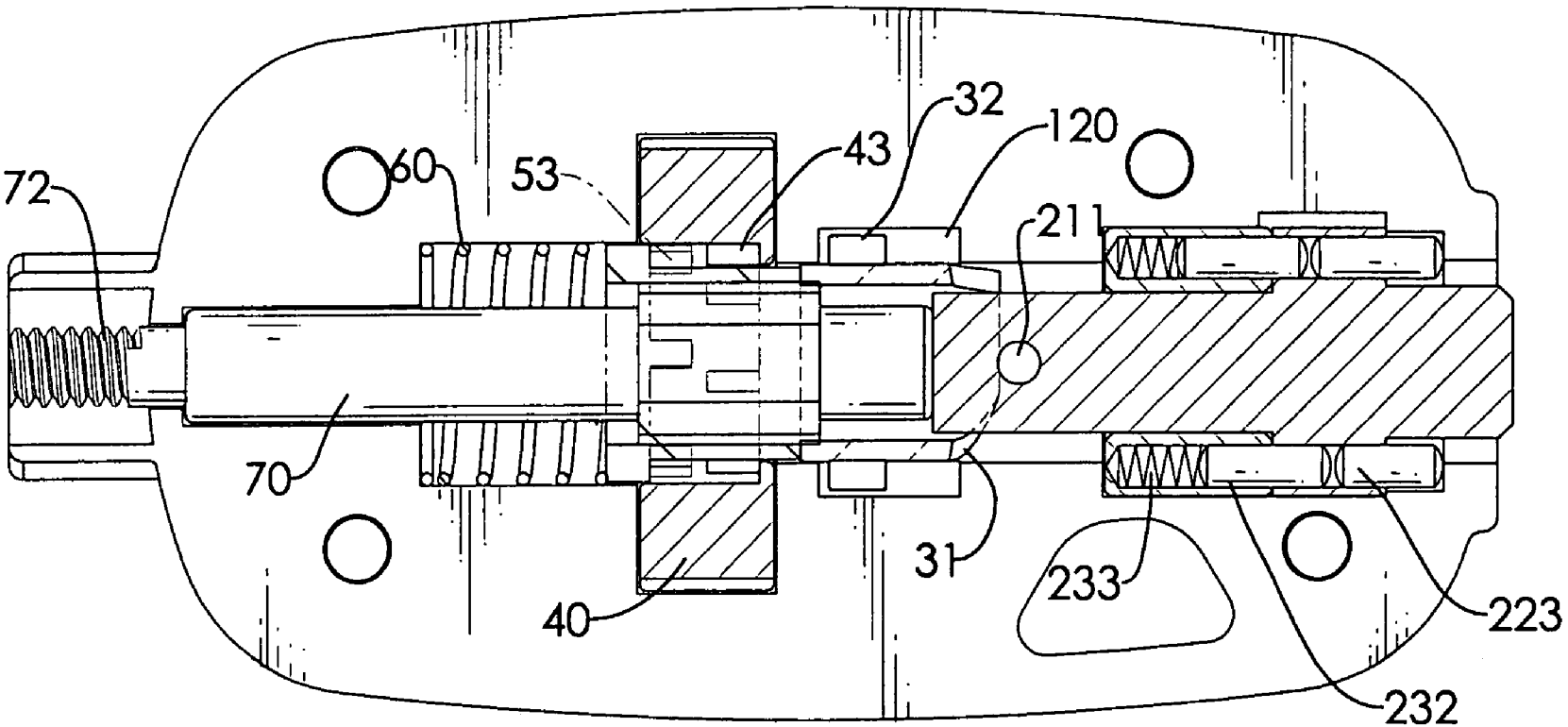
FIG. 5 is a top view in partial cross section of the lock assembly in FIG. 1 in a lock position.

With further reference to FIG. 5, since the active bracket (50) is pushed by the resilient element (60), the end of the active bracket (50) opposite to the head (52) can push the active tube (30) to move axially close to the proximal end of the casing (10) in the second chamber (12) of the casing (10). The user can use the associated key (80) to rotate the locking bar (21) and the active rod (211) relative to the stationary cylinder (23). When the active rod (211) rotates and slides along the inclined planes of the notches (31) in the active tube (30), the active tube (30) and the active bracket (50) may move gradually toward the lock cylinder (20) at the same time. Eventually, the active teeth (53) engages with the teeth (43) in the wheel (40). When the active teeth (53) engages with the teeth (43), rotating the wheel (40) simultaneously rotates the active bracket (50) and the securing axle (70).

With further reference to FIG. 7, the operational cable (82) has two ends, one of the ends is fixed with the lock assembly of the present invention, and the other end has a loop (820). When an article (such as a notebook computer) having a corresponding threaded hole needs to be secured in a certain position, the lock assembly passes through the loop (820) of the cable (82) to tie the cable (82) to a stationary facility. Then the key (80) is inserted and turned to engage the active teeth (53) and the teeth (43). Then the wheel (40) is rotated to screw the threaded end (72) of the securing axle (70) into the corresponding threaded hole of the article. After the securing axle (70) is screwed into the article, the key (80) is turned to disengage the active teeth (53) from the teeth (43). Then the securing axle (70) disengages with the wheel (40) and may remain in the article. Therefore, the article can be effectively fastened in a certain position.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A lock assembly comprising:

a casing having
- a proximal end;
- a distal end; and
- a receiving space defined in the casing and having two sides;

a lock cylinder being mounted in the receiving space of the casing near the proximal end and having
- a locking bar mounted rotatably in the receiving space of the casing, wherein when the lock cylinder is locked, the locking bar is not rotated relative to the casing, and when the lock cylinder is unlocked, the locking bar is rotated relative to the casing, and the locking bar having
  - a latching end having
    - a through hole formed transversely in the latching end; and
    - an active rod mounted in the through hole with two ends protruding out of the through hole;

an active tube being mounted slidably in the receiving space of the casing and having
- a first end opposite to the latching end of the locking bar;
- a second end;
- two sides;
- two notches being oppositely defined on the first end of the active tube and corresponding to the active rod, and each notch having an inclined plane;

a wheel being mounted rotatably in the receiving space of the casing and having
- a center;
- a hole with an inner surface formed through the center of the wheel; and
- multiple teeth formed around the inner surface;

an active bracket being slidably mounted rotatably in the receiving space of the casing and having
- an outer wall;
- a first end abutting the second end of the active tube;
- a second end;
- a head being formed on the second end and having multiple active teeth extending on the outer wall of the active bracket and corresponding to and selectively engaging the teeth in the wheel;

a non-circular mounting hole being formed axially through the active bracket;

a resilient element being mounted in the receiving space of the casing and having an end pushing the active bracket to slide along the receiving space of the casing to engage the active teeth of the active bracket with the teeth in the wheel;

a securing axle being mounted rotatably in the receiving space of the casing and having a threaded end extending out of the casing;

an active end; and a mounting portion being formed on the securing axle near the active end and being non-circular in cross section to be mounted securely in the mounting hole of the active bracket.

2. The lock assembly as claimed in claim 1, wherein the lock cylinder further comprises a stationary cylinder being securely held in the receiving space of the casing and comprising an end surface;

multiple bores being formed separately in the end surface of the stationary cylinder; and multiple tumbler pins and tumbler springs being mounted in the bores; and the locking bar of the lock cylinder further comprises an active cylinder being formed radially on the locking bar, coaxial with the stationary cylinder and comprising an outer surface; and multiple pin holes being formed longitudinally through the active cylinder and around the locking bar, and each pin hole having a bolt mounted slidably in the pin hole, and each bolt corresponding to and pushed by one of the tumbler pins.

3. The lock assembly as claimed in claim 2, wherein the receiving space of the casing further has a cave being formed transversely in the casing near the proximal end of the casing; and the active cylinder of the locking bar further comprises a flange being formed longitudinally on the outer surface of the active cylinder and being mounted movably in the cave of the receiving space of the casing.

4. The lock assembly as claimed in claim 2, wherein the receiving space of the casing further has two sides and two slots respectively defined at the two sides of the receiving space; and the active tube further comprises two bosses being formed respectively at the two sides of the active tube, and each boss being mounted slidably in one of the slots in the receiving space of the casing.

5. The lock assembly as claimed in claim 2, wherein the casing further comprises a top case having a surface and an opening defined through the surface; and the wheel has a rough surface extending out of the opening of the top case of the casing.

* * * * *